US010001138B2

(12) United States Patent
Ganesh et al.

(10) Patent No.: US 10,001,138 B2
(45) Date of Patent: Jun. 19, 2018

(54) POWERED VENTILATORS

(71) Applicant: Twin City Fan Companies, Ltd., Plymouth, MN (US)

(72) Inventors: Radha Krishna Ganesh, Plymouth, MN (US); Daniel Schulz, St. Michael, MN (US); Matt Settergren, Plymouth, MN (US)

(73) Assignee: Twin City Fan Companies, Ltd., Plymouth, MN (US)

( * ) Notice: Subject to any disclaimer, the term of this patent is extended or adjusted under 35 U.S.C. 154(b) by 500 days.

(21) Appl. No.: 14/447,113

(22) Filed: Jul. 30, 2014

(65) Prior Publication Data

US 2015/0086349 A1 Mar. 26, 2015

Related U.S. Application Data

(60) Provisional application No. 61/859,999, filed on Jul. 30, 2013.

(51) Int. Cl.

| | |
|---|---|
| ***F04D 29/44*** | (2006.01) |
| ***F04D 17/16*** | (2006.01) |
| ***F04D 29/42*** | (2006.01) |
| ***F04D 29/54*** | (2006.01) |
| ***F24F 7/02*** | (2006.01) |

(52) U.S. Cl.

CPC ..... *F04D 29/441* (2013.01); *F04D 17/16* (2013.01); *F04D 17/165* (2013.01); *F04D 29/4253* (2013.01); *F04D 29/547* (2013.01); *F24F 7/025* (2013.01)

(58) Field of Classification Search

CPC ..... F04D 29/441; F04D 17/16; F04D 17/165; F04D 29/4253; F04D 29/547; F04D 29/4206; F04D 29/4226; F24F 7/025

See application file for complete search history.

(56) References Cited

U.S. PATENT DOCUMENTS 2,982,198 A * 5/1961 Mohrman ..... F24F 7/025 454/356

* cited by examiner

*Primary Examiner* — Christopher Verdier

(74) *Attorney, Agent, or Firm* — Schwegman Lundberg & Woessner, P.A.

(57) ABSTRACT

A number of fan assemblies are shown. Configurations are shown that include one or more diffusers. Diffuser locations and specific diffuser configurations are described that improve one or more fan assembly characteristics, including, but not limited to fan efficiency.

3 Claims, 10 Drawing Sheets

POWERED VENTILATORS

CLAIM OF PRIORITY

This application claims the benefit of U.S. Provisional Patent Application Ser. No. 61/859,999, entitled, "POWERED VENTILATORS", filed Jul. 30, 2013, which is hereby incorporated by reference in its entirety.

TECHNICAL FIELD

Embodiments described herein generally relate to fan assemblies. Specific examples may include ventilator fan housings and fan assemblies.

BACKGROUND

In fan assemblies, such as centrifugal, axial, or mixed flow fan assemblies, velocity energy at a periphery of an impeller may be wasted as velocity energy. An improved fan assembly and methods that addresses at least these concerns are desired.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Powered roof and wall ventilators are commonly used in commercial and industrial ventilation. These ventilators use centrifugal, axial and mixed flow impellers. The impeller blade profiles can be airfoil or single thickness arranged in a backward curved or inclined configuration. One method to enhance the performance of these ventilators is to add a diffuser (vane or vaneless) at the periphery of the impeller to recover as much of the velocity energy (which is usually wasted) into useful pressure energy.

Figure 1:
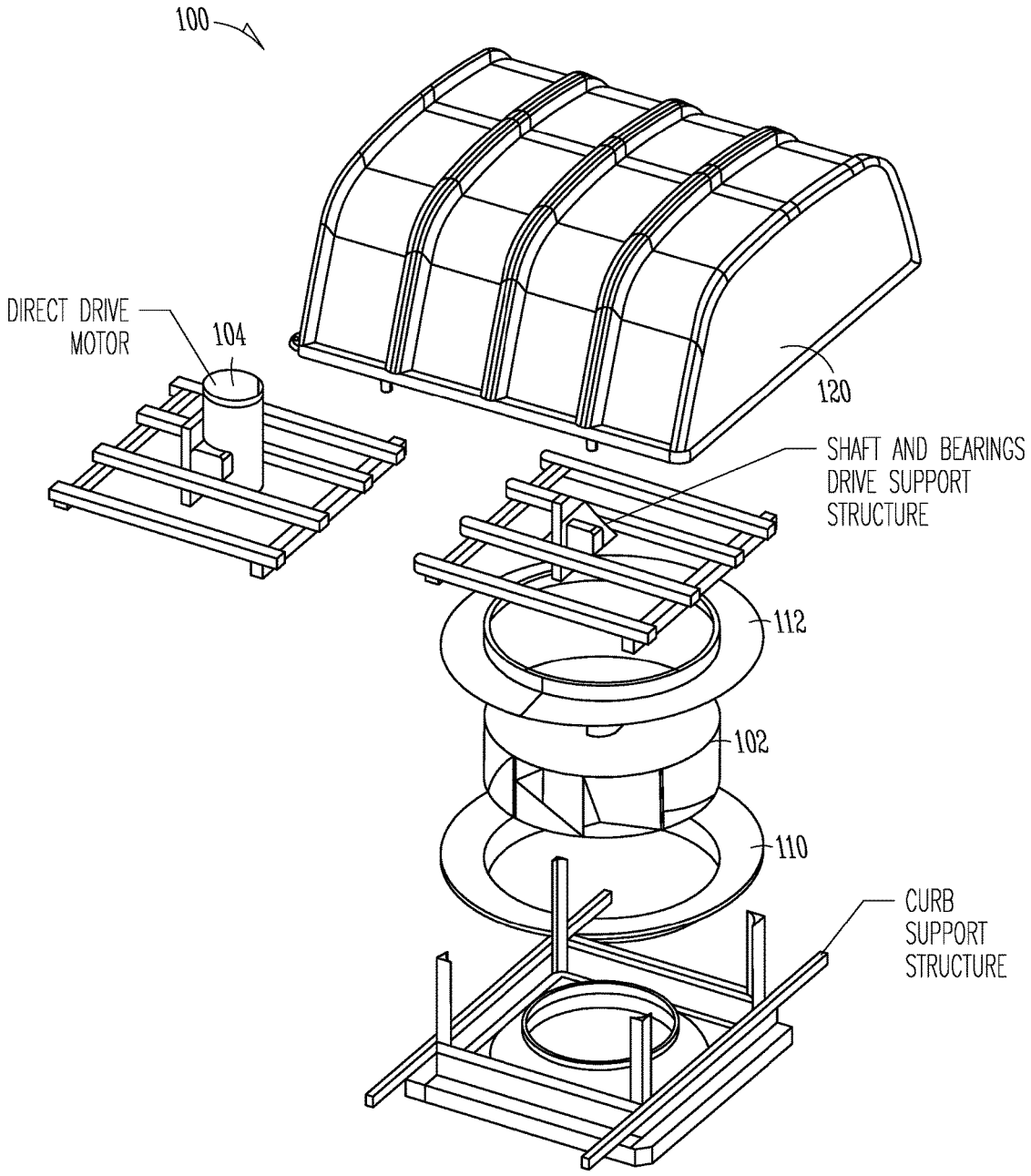
FIG. 1 is an exploded view of a centrifugal ventilator fan assembly in accordance with some embodiments of the invention.

FIG. 1 shows one example of a fan assembly 100. The fan assembly 100 includes an impeller 102 and a motor 104. In the example shown, a first diffuser 110 and a second diffuser 112 are shown located at a periphery of the impeller 102. A hood 120 is further shown in the example of FIG. 1.

Figure 2:
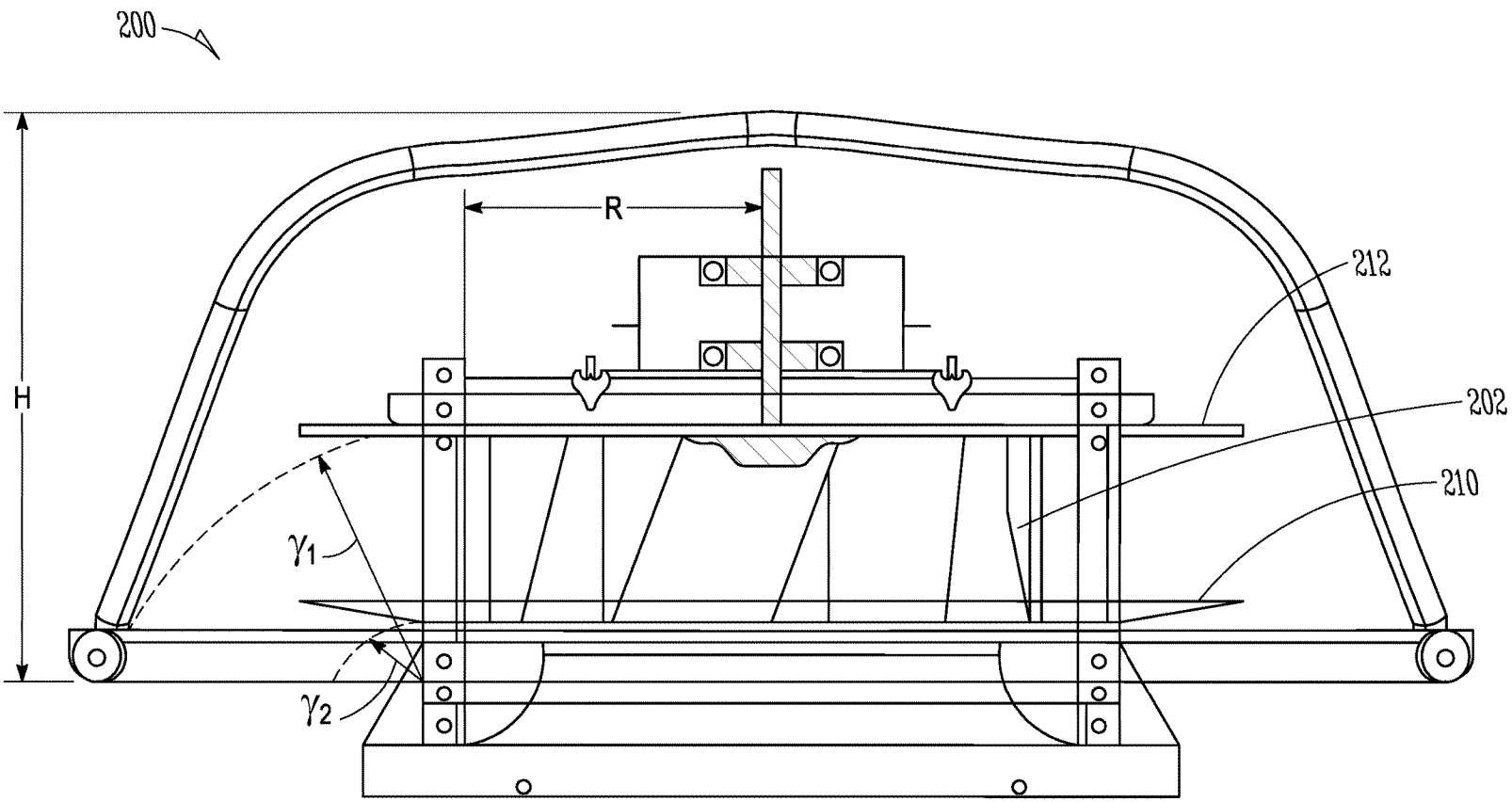
FIG. 2 is an cross section view of a centrifugal ventilator fan assembly in accordance with some embodiments of the invention.

FIG. 2 shows another example of a fan assembly 200. The fan assembly 200 includes an impeller 202. In the example shown, the impeller 202 is a centrifugal impeller. In the example shown, a first diffuser 210 and a second diffuser 212 are shown located at a periphery of the impeller 202.

In one example, specific geometric relationships have been found to provide exemplary performance. In the example of FIG. 2, the following geometric relationships provide exemplary performance:

$$R = \text{wheel radius}$$

$$0.1 \le \frac{\gamma_1}{R} \le 0.6$$

$$0.05 \le \frac{\gamma_2}{R} \le 0.3$$

$$0.5 \le \frac{H}{R} \le 2$$

Figure 3:
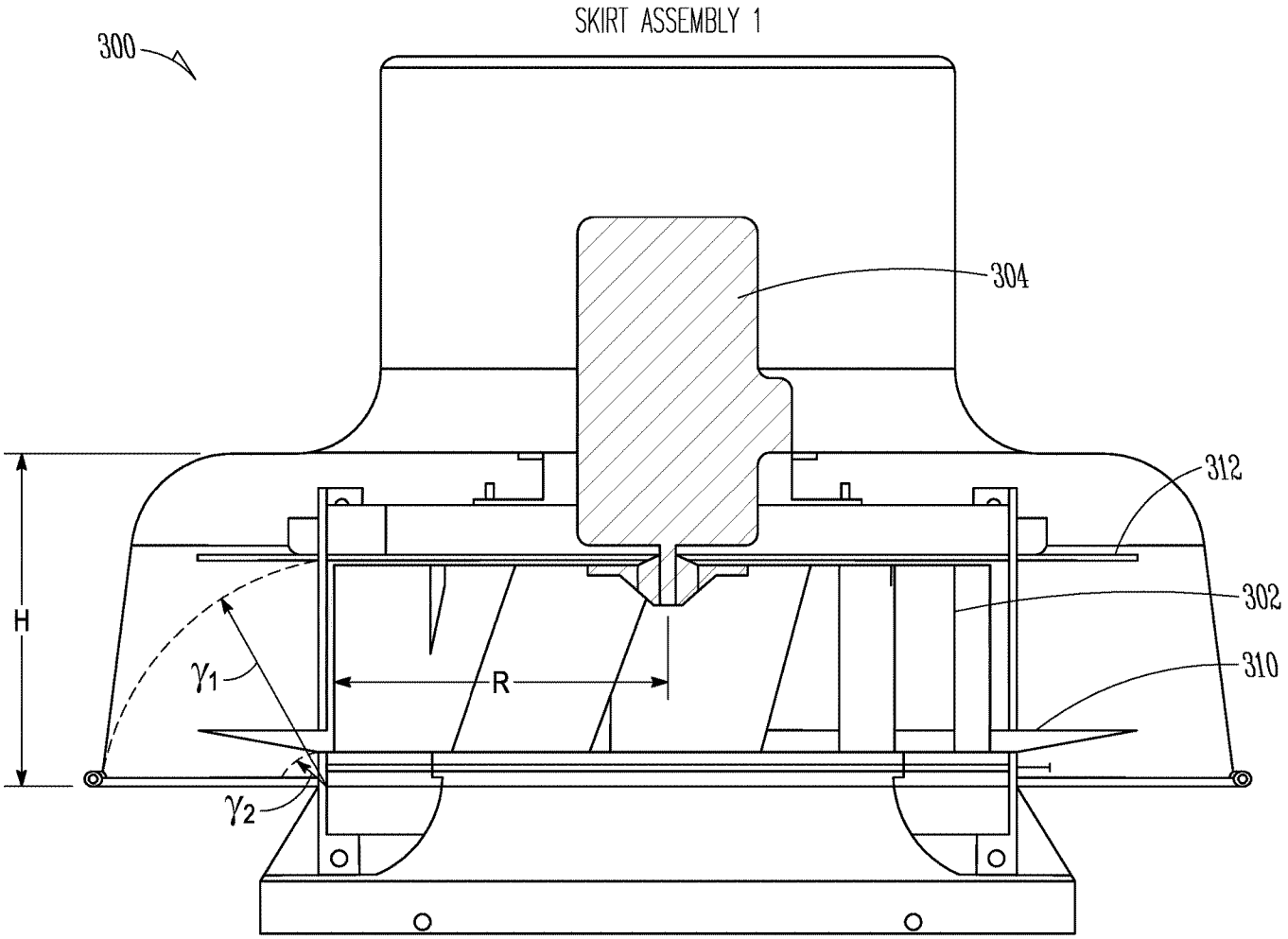
FIG. 3 is an cross section view of a centrifugal ventilator fan assembly in accordance with some embodiments of the invention.

FIG. 3 shows another example of a fan assembly 300. The fan assembly 300 includes an impeller 302. In the example shown, the impeller 302 is a centrifugal impeller. A motor 304 is further shown in the example of FIG. 3. In the example shown, a first diffuser 310 and a second diffuser 312 are shown located at a periphery of the impeller 302.

In one example, specific geometric relationships have been found to provide exemplary performance. In the example of FIG. 3, the following geometric relationships provide exemplary performance:

$$\frac{H}{R}, \frac{\gamma_1}{R}, \frac{\gamma_2}{R} \text{ values are the same as above}$$

Figure 4:
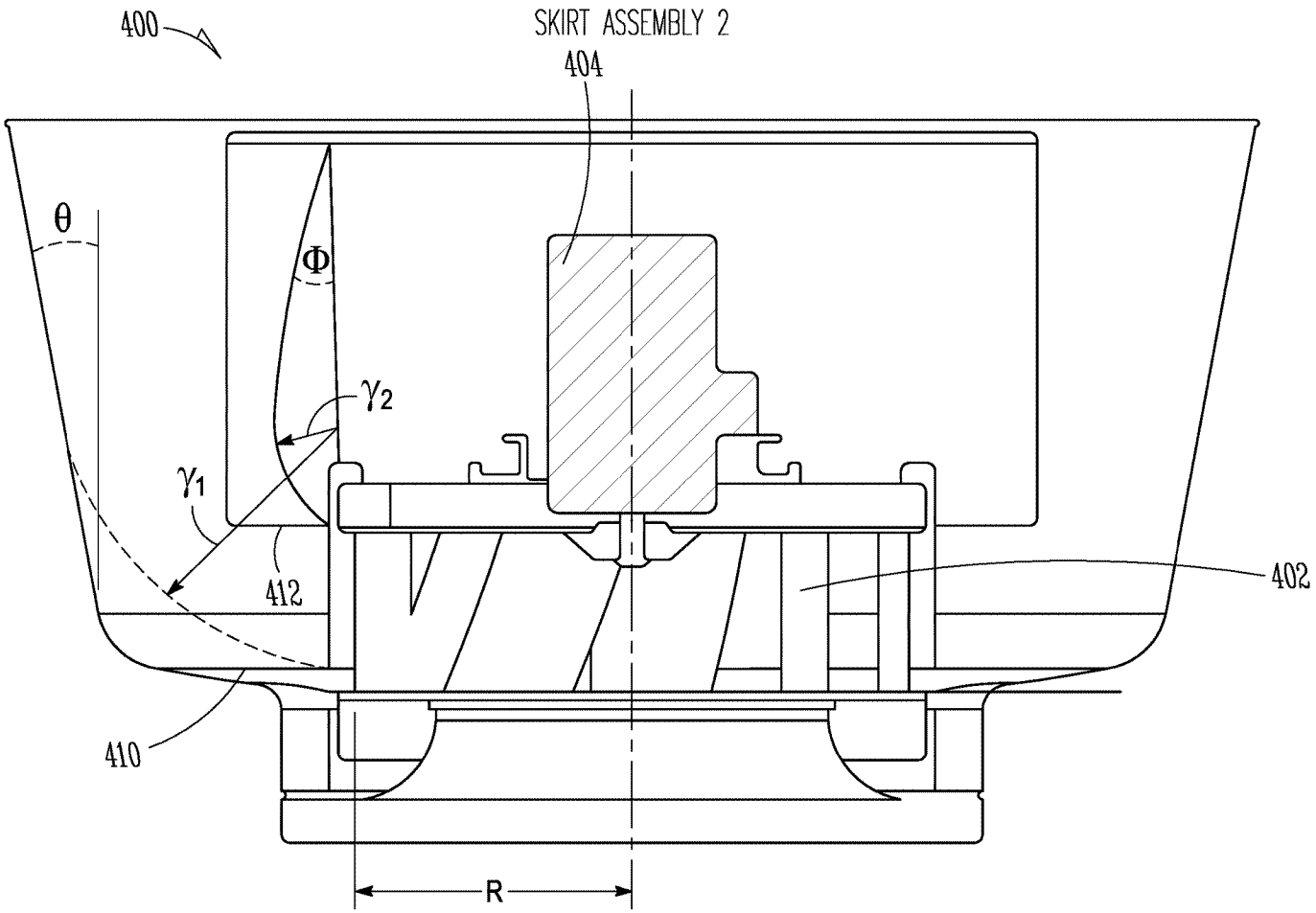
FIG. 4 is an cross section view of a centrifugal ventilator fan assembly in accordance with some embodiments of the invention.

FIG. 4 shows another example of a fan assembly 400. The fan assembly 400 includes an impeller 402. In the example shown, the impeller 402 is a centrifugal impeller. A motor 404 is further shown in the example of FIG. 4. In the example shown, a first diffuser 410 and a second diffuser 412 are shown located at a periphery of the impeller 402.

In one example, specific geometric relationships have been found to provide exemplary performance. In the example of FIG. 4, the following geometric relationships provide exemplary performance:

$$0 \le \theta \le 25$$

$$0 \le \varphi \le 25$$

$\frac{\gamma_1}{R}, \frac{\gamma_2}{R}$ values are the same as above $$0.5 \le \frac{H}{R} \le 3.0$$

Figure 5:
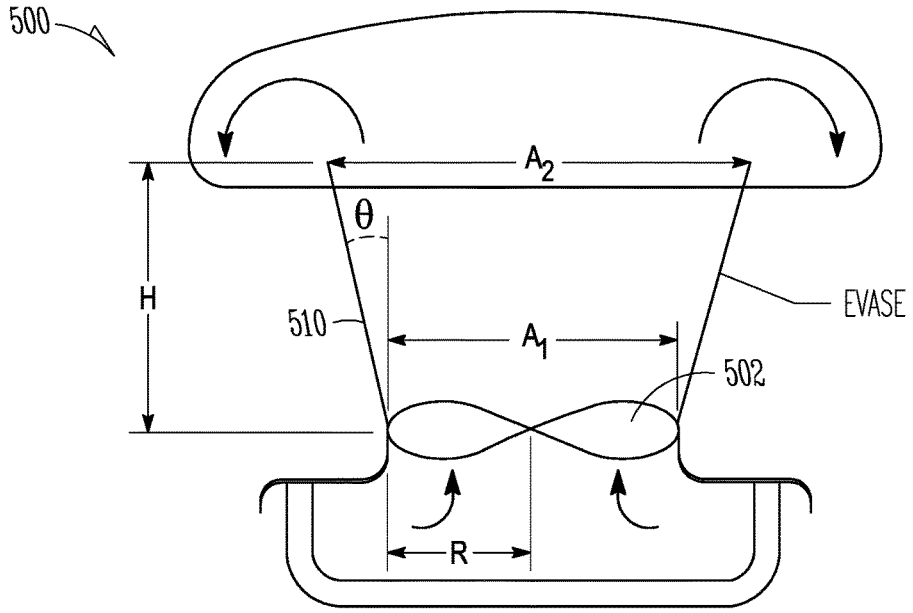
FIG. 5 is an cross section view of an axial ventilator fan assembly in accordance with some embodiments of the invention.

FIG. 5 shows another example of a fan assembly 500. The fan assembly 500 includes an impeller 502. In the example shown, the impeller 502 is an axial impeller. In the example shown, a diffuser 510 is shown located at a periphery of the impeller 502. In the example shown, the diffuser is integrated as part of the housing of the fan assembly 500.

Figure 6:
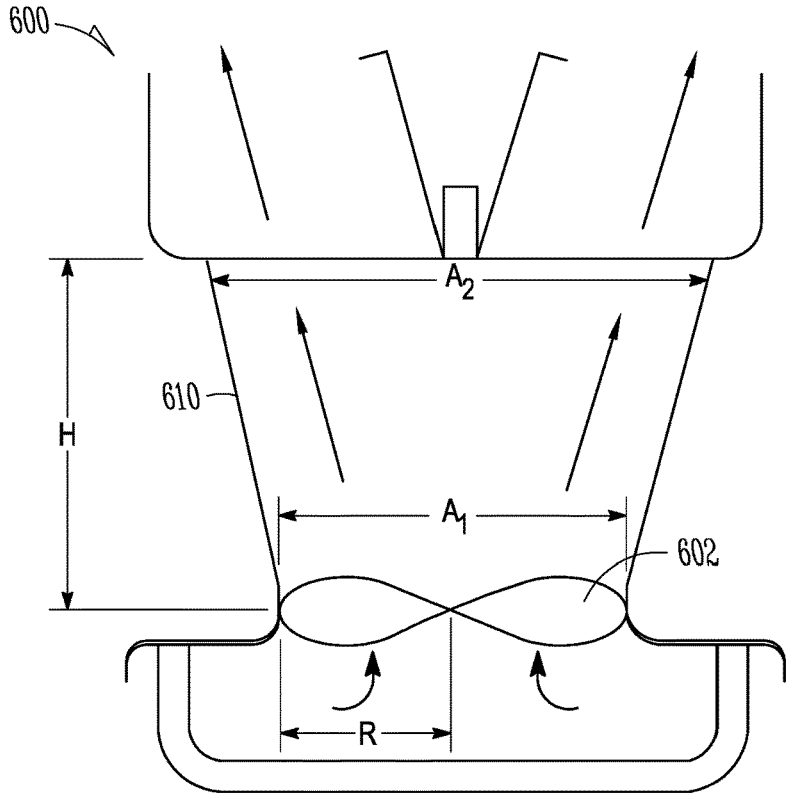
FIG. 6 is an cross section view of an axial ventilator fan assembly in accordance with some embodiments of the invention.

FIG. 6 shows another example of a fan assembly 600. The fan assembly 600 includes an impeller 602. In the example shown, the impeller 602 is an axial impeller. In the example shown, a diffuser 610 is shown located at a periphery of the impeller 602. In the example shown, the diffuser is integrated as part of the housing of the fan assembly 600.

In one example, specific geometric relationships have been found to provide exemplary performance. In the example of FIGS. 5 and 6, the following geometric relationships provide exemplary performance:

$$H = \textit{approx. BCRU skirt height}$$

$$H = 28.25''$$

$$\theta = 7.5^\circ \textit{ per side} \Longrightarrow 15^\circ \textit{ total}$$

$$A_1 = \frac{\pi\left(\frac{24}{12}\right)^2}{4} = 3.14 \text{ sq. ft.}$$

$$A_2 = \frac{\pi\left(\frac{31.44}{12}\right)^2}{4} = 5.39 \text{ sq. ft.}$$

$$0.5 \le \frac{H}{R} \le 3.0$$

$$0 \le \theta \le 20$$

$$D_1 = 24''$$

$$D_2 = 24 + 2(28.25 \tan 7.5^\circ)$$

$$D_2 = 31.44''$$

Figure 7:
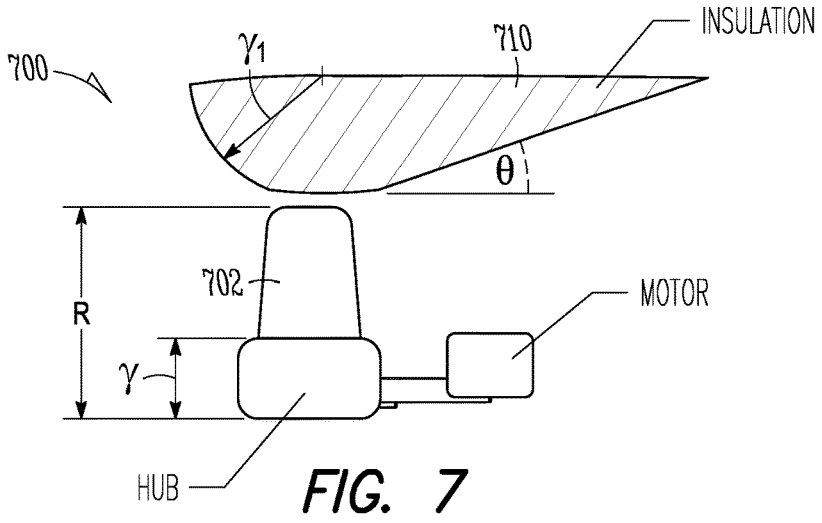
FIG. 7 is an cross section view of an axial ventilator fan assembly in accordance with some embodiments of the invention.

FIG. 7 shows another example of a fan assembly 700. The fan assembly 700 includes an impeller 702. In the example shown, the impeller 702 is an axial impeller. In the example shown, a diffuser 710 is shown located at a periphery of the impeller 702.

Figure 8:
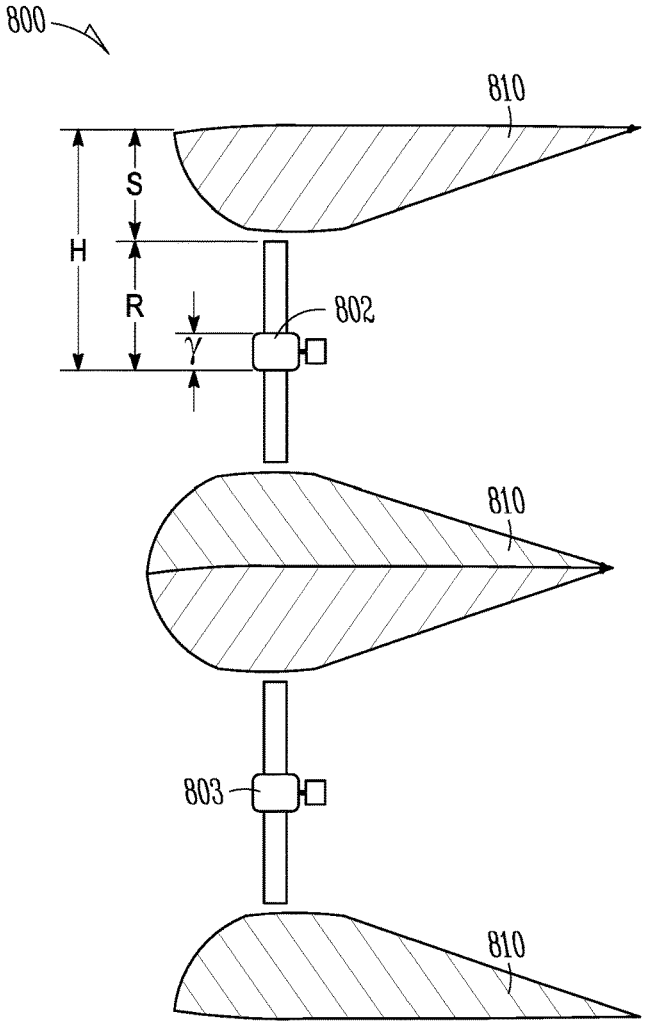
FIG. 8 is an cross section view of an axial array ventilator fan assembly in accordance with some embodiments of the invention.

FIG. 8 shows another example of a fan assembly 800. The example of FIG. 8 includes an array of impellers. In the example shown, the fan assembly 800 includes a first impeller 802 and a second impeller 803. In the example shown, the impellers 802, 803 are axial impellers. In the example shown, a diffusers 810 are shown located at a periphery of the impellers 802, 803.

Figure 9:
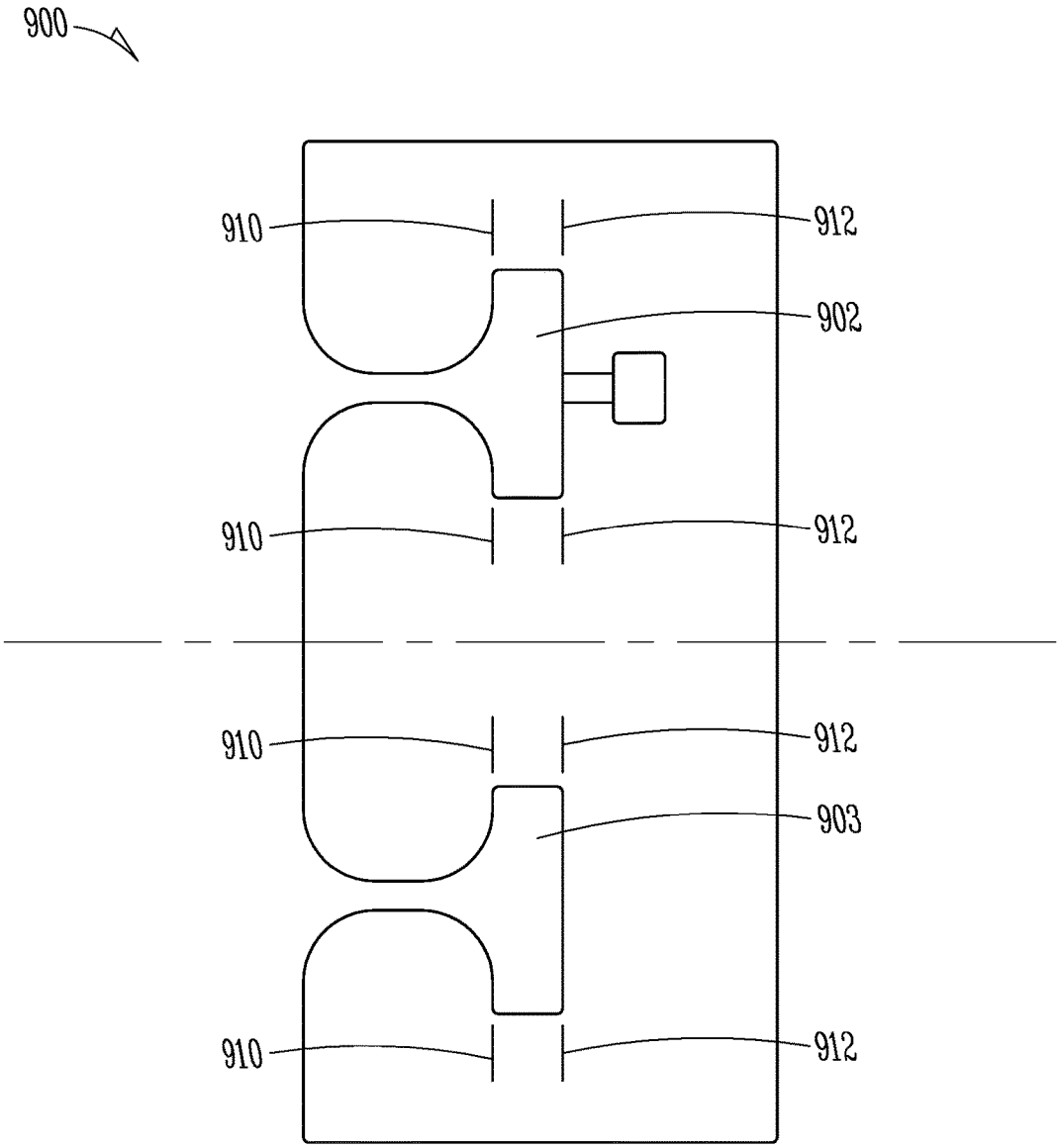
FIG. 9 is an cross section view of an centrifugal array ventilator fan assembly in accordance with some embodiments of the invention.

FIG. 9 shows another example of a fan assembly 900. The example of FIG. 9 includes an array of impellers. In the example shown, the fan assembly 900 includes a first impeller 902 and a second impeller 903. In the example shown, the impellers 902, 903 are centrifugal impellers. In the example shown, first diffusers 910 and second diffusers 912 are shown located at a periphery of the impellers 902, 903.

In one example, specific geometric relationships have been found to provide exemplary performance. In the example of FIGS. 7, 8, and 9 the following geometric relationships provide exemplary performance:

$$0.2 \le \frac{\gamma}{R} \le 0.7$$

$$0 \le \theta \le 20$$

$$0.2 \le \frac{\gamma_1}{R} \le 1.0$$

$$0.2 \le \frac{S}{R} \le 0.6$$

Figure 10:
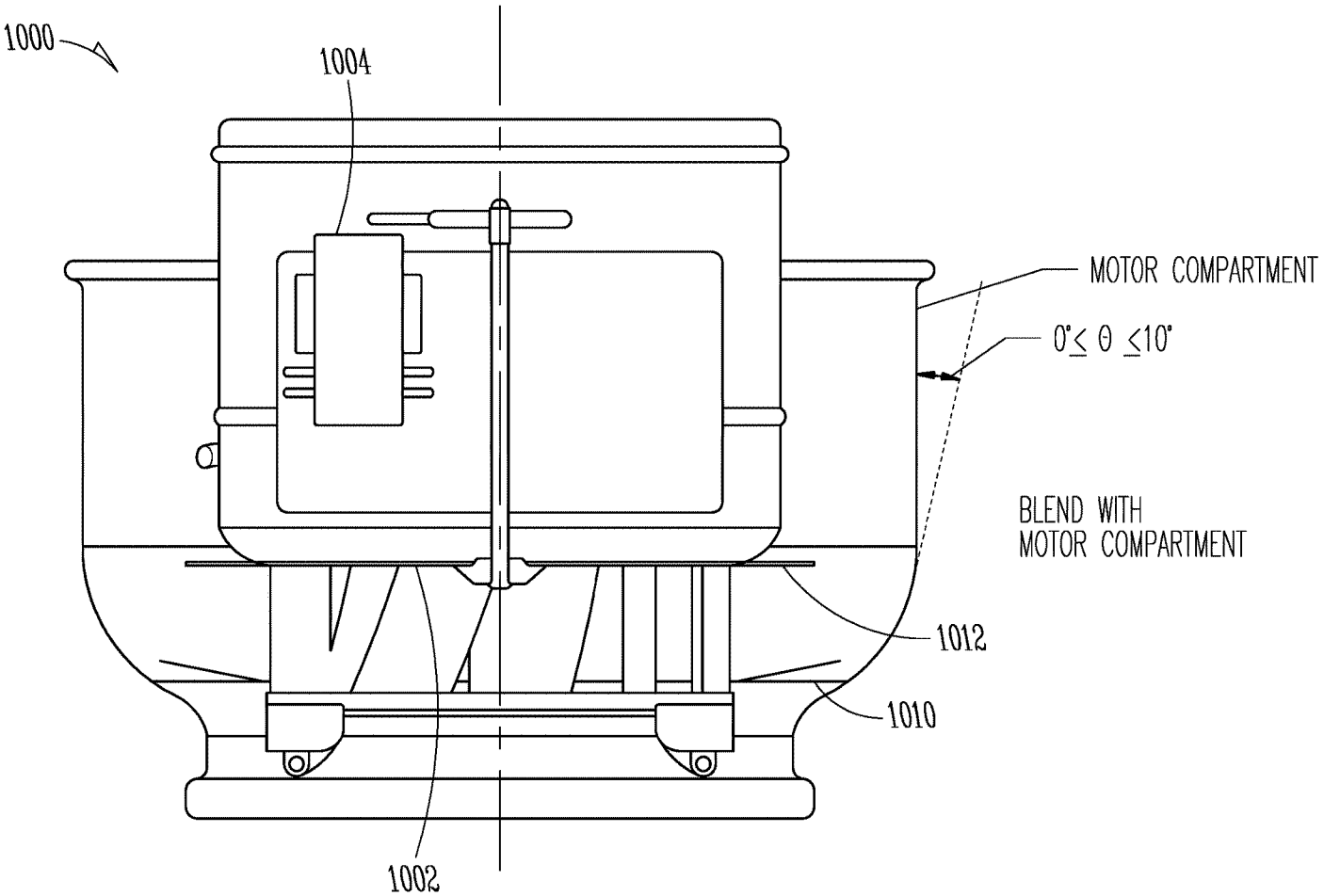
FIG. 10 is an cross section view of an centrifugal ventilator fan assembly in accordance with some embodiments of the invention.

FIG. 10 shows another example of a fan assembly 1000. The fan assembly 1000 includes an impeller 1002. In the example shown, the impeller 1002 is a centrifugal impeller. A motor 1004 is further shown in the example of FIG. 10. In the example shown, the motor 1004 is offset, and drives the impeller 1002 using a belt. In the example shown, a first diffuser 1010 and a second diffuser 1012 are shown located at a periphery of the impeller 1002. In one example the first diffuser 1010 is integrated as part of a housing of the fan assembly 1000. In one example the second diffuser 1012 is integrated as part of a motor compartment of the fan assembly 1000.

Figure 11:
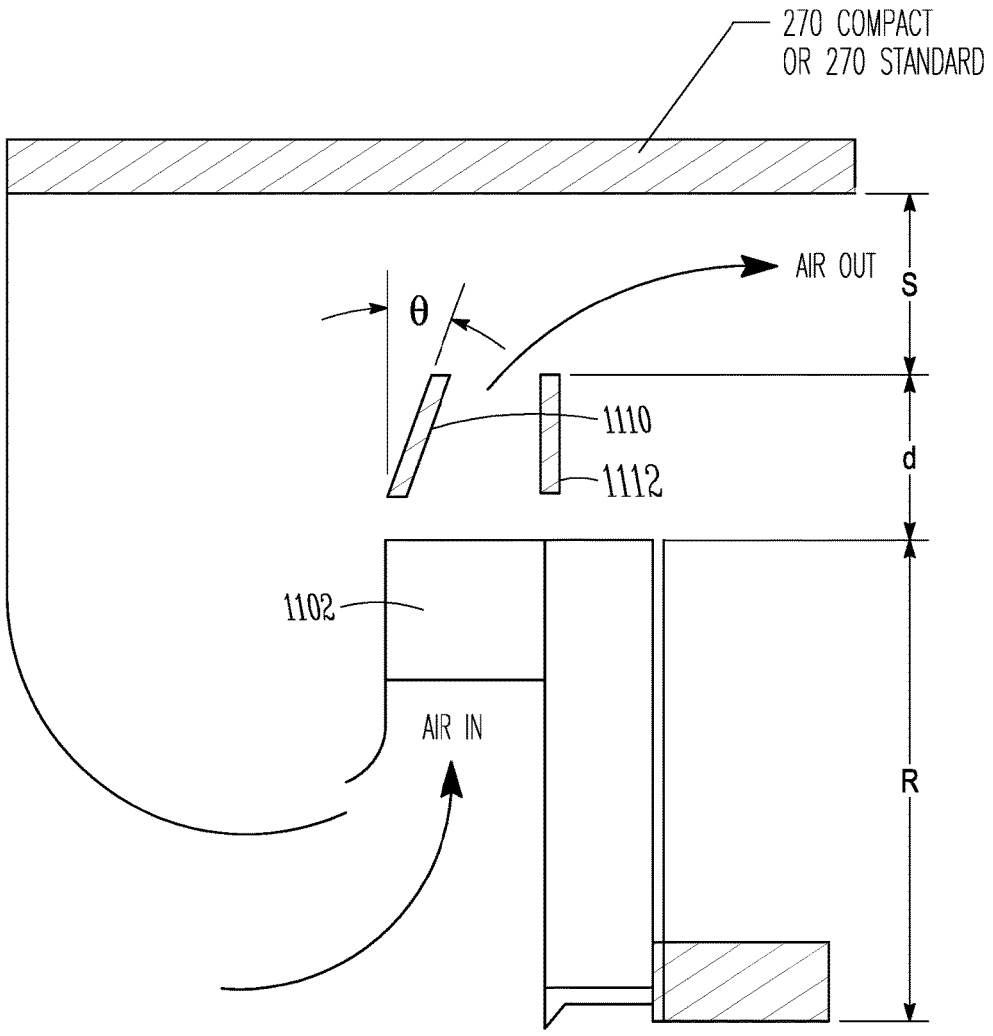
FIG. 11 is an cross section view of an centrifugal ventilator fan assembly in accordance with some embodiments of the invention.

FIG. 11 shows another example of a fan assembly 1100. The fan assembly 1100 includes an impeller 1102. In the example shown, the impeller 1102 is a centrifugal impeller. In the example shown, a first diffuser 1110 and a second diffuser 1112 are shown located at a periphery of the impeller 1102.

In one example, specific geometric relationships have been found to provide exemplary performance. In the example of FIG. 11, the following geometric relationships provide exemplary performance:

$$0.1 \le \frac{d}{R} \le 0.4$$

$$0.2 \le \frac{S}{R} \le 0.5$$

$$0 \le \theta \le 25$$

Figure 12:
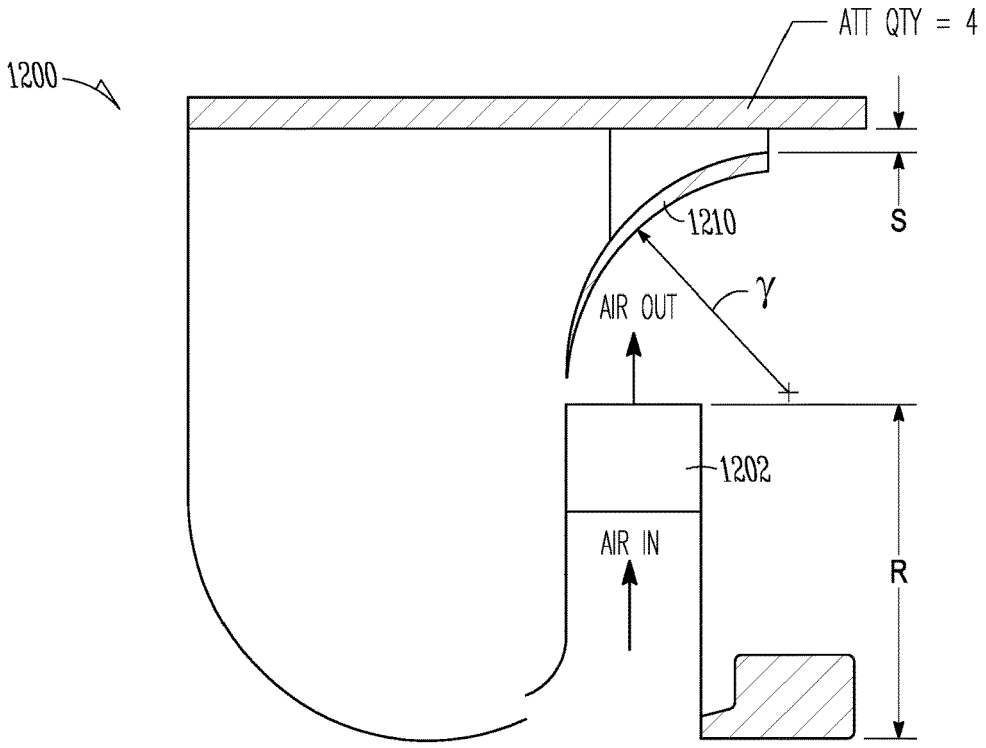
FIG. 12 is an cross section view of an centrifugal ventilator fan assembly in accordance with some embodiments of the invention.

FIG. 12 shows another example of a fan assembly 1200. The fan assembly 1200 includes an impeller 1202. In the example shown, the impeller 1102 is a centrifugal impeller. In the example shown, a diffuser 1210 is shown located at a periphery of the impeller 1202.

In one example, specific geometric relationships have been found to provide exemplary performance. In the example of FIG. 11, the following geometric relationships provide exemplary performance:

$$0.005 \le \frac{S}{R} \le 0.1$$

$$0.3 \le \frac{\gamma}{R} \le 1.0$$

Figure 13:
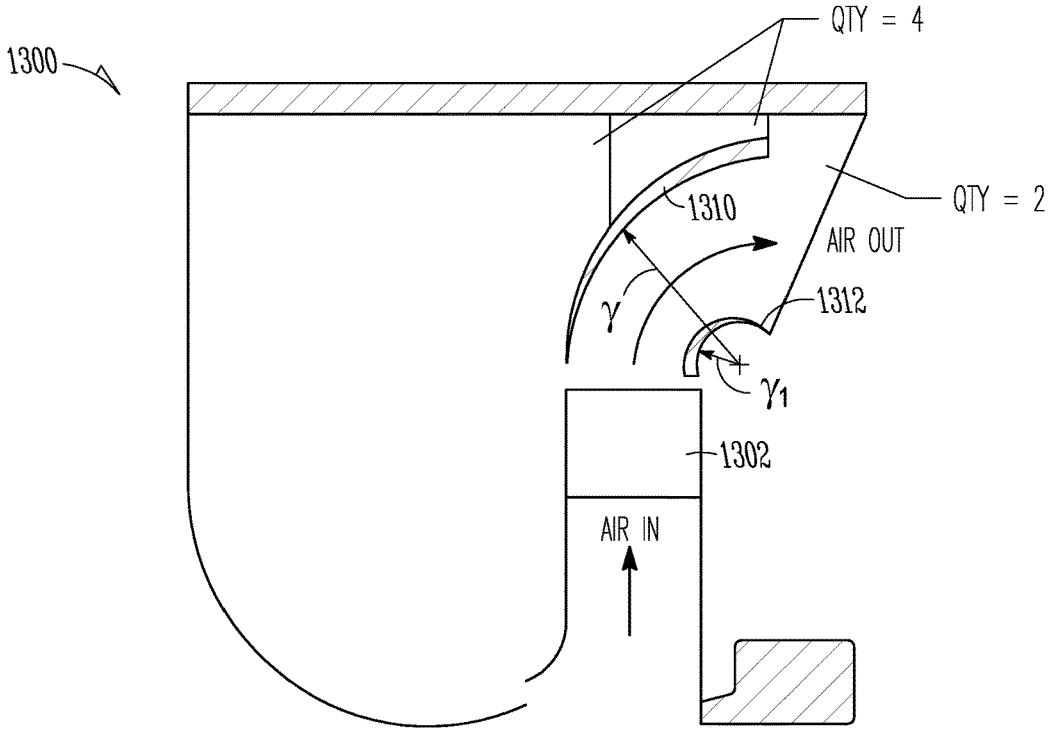
FIG. 13 is an cross section view of an centrifugal ventilator fan assembly in accordance with some embodiments of the invention.

FIG. 13 shows another example of a fan assembly 1300. The fan assembly 1300 includes an impeller 1302. In the example shown, the impeller 1302 is a centrifugal impeller. In the example shown, a first diffuser 1310 and a second diffuser 1312 are shown located at a periphery of the impeller 1302.

In one example, specific geometric relationships have been found to provide exemplary performance. In the example of FIG. 13, the following geometric relationships provide exemplary performance:

$$0.3 \leq \frac{\gamma_1}{\gamma} \leq 0.5$$

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A fan assembly, comprising:

an impeller, including a plurality of blades, wherein the impeller has a radius R;

a motor coupled to the impeller;

a pair of diffusers located at a periphery of the impeller a hood covering the impeller, the hood having a height H, wherein a second diffuser of the pair of diffusers is located a distance $\gamma_1$ from a bottom edge of the hood, and a first diffuser of the pair of diffusers is located a distance $\gamma_2$ from the bottom edge of the hood, and wherein a ratio of $$\frac{\gamma^1}{R}$$

is defined as $$0.1 \leq \frac{\gamma^1}{R} \leq 0.6,$$

and a ratio of $$\frac{\gamma^2}{R}$$

is defined as $$0.05 \leq \frac{\gamma^2}{R} \leq 0.3.$$

2. The fan assembly of claim 1, wherein a ratio of H/R is defined as $0.5 \leq H/R \leq 2$.

3. The fan assembly of claim 1, wherein the hood is rectangular.

* * * * *